US009476639B2

(12) United States Patent
Martinez et al.

(10) Patent No.: US 9,476,639 B2
(45) Date of Patent: Oct. 25, 2016

(54) HYDROCARBON GAS PROCESSING FEATURING A COMPRESSED REFLUX STREAM FORMED BY COMBINING A PORTION OF COLUMN RESIDUE GAS WITH A DISTILLATION VAPOR STREAM WITHDRAWN FROM THE SIDE OF THE COLUMN

(75) Inventors: Tony L. Martinez, Midland, TX (US); John D. Wilkinson, Midland, TX (US); Joe T. Lynch, Midland, TX (US); Hank M. Hudson, Midland, TX (US); Kyle T. Cuellar, Katy, TX (US)

(73) Assignee: Ortloff Engineers, Ltd., Midland, TX (US)

( * ) Notice: Subject to any disclaimer, the term of this patent is extended or adjusted under 35 U.S.C. 154(b) by 1336 days.

(21) Appl. No.: 12/869,007

(22) Filed: Aug. 26, 2010

(65) Prior Publication Data

US 2011/0067442 A1 Mar. 24, 2011

Related U.S. Application Data

(60) Provisional application No. 61/351,045, filed on Jun. 3, 2010, provisional application No. 61/346,150, filed on May 19, 2010, provisional application No. 61/244,181, filed on Sep. 21, 2009.

(51) Int. Cl.
*F25J 3/02* (2006.01)

(52) U.S. Cl.
CPC ..... *F25J 3/0209* (2013.01); *F25J 3/0233* (2013.01); *F25J 3/0238* (2013.01); (Continued)

(58) Field of Classification Search
CPC ..... F25J 3/0209; F25J 3/0233; F25J 3/0238; F25J 220/02; F25J 220/72; F25J 2205/04; F25J 2210/06; F25J 2230/08; F25J 2230/32; F25J 2240/02; F25J 2290/40
USPC ..... 62/618, 619, 620, 621
See application file for complete search history.

(56) References Cited

U.S. PATENT DOCUMENTS 33,408 A 10/1861 Turner et al. ..... 62/22 R
2,952,984 A 6/1958 Marshall, Jr. ..... 62/622
(Continued)

OTHER PUBLICATIONS

Mowrey, E. Ross., "Efficient, High Recovery of Liquids from Natural Gas Utilizing a High Pressure Absorber," Proceedings of the Eighty-First Annual Convention of the Gas Processors Association, Dallas, Texas, Mar. 11-13, 2002—10 pages.

*Primary Examiner* — John F Pettitt
(74) *Attorney, Agent, or Firm* — Fitzpatrick, Cella, Harper & Scinto

(57) ABSTRACT

A process and an apparatus are disclosed for the recovery of ethane, ethylene, propane, propylene, and heavier hydrocarbon components from a hydrocarbon gas stream. The stream is cooled and divided into first and second streams. The first stream is further cooled to condense substantially all of it and divided into first and second portions. The first and second portions are expanded to the fractionation tower pressure and supplied to the fractionation tower at upper mid-column feed positions, with the expanded second portion being heated before it enters the tower. The second stream is expanded to the tower pressure and supplied to the column at a mid-column feed position. A distillation vapor stream is withdrawn from the column above the feed point of the second stream, combined with a portion of the tower overhead vapor stream, compressed to higher pressure, and directed into heat exchange relation with the remaining tower overhead vapor stream and the expanded second portion to cool the compressed combined vapor stream and condense at least a part of it, forming a condensed stream. At least a portion of the condensed stream is expanded to the tower pressure and directed to the fractionation tower as its top feed. The quantities and temperatures of the feeds to the fractionation tower are effective to maintain the overhead temperature of the fractionation tower at a temperature whereby the major portion of the desired components is recovered.

4 Claims, 6 Drawing Sheets

(52) U.S. Cl.
CPC ..... *F25J 2200/02* (2013.01); *F25J 2200/30* (2013.01); *F25J 2200/76* (2013.01); *F25J 2200/78* (2013.01); *F25J 2200/90* (2013.01); *F25J 2205/04* (2013.01); *F25J 2210/06* (2013.01); *F25J 2230/08* (2013.01); *F25J 2240/02* (2013.01); *F25J 2290/40* (2013.01)

(56) References Cited

U.S. PATENT DOCUMENTS

| | | | | |
|---|---|---|---|---|
| 3,292,380 | A | 12/1966 | Bucklin | 62/621 |
| 3,837,172 | A | 9/1974 | Markbreiter et al. | 62/621 |
| 4,061,481 | A | 12/1977 | Campbell et al. | 62/621 |
| 4,140,504 | A | 2/1979 | Campbell et al. | 62/621 |
| 4,157,904 | A | 6/1979 | Campbell et al. | 62/623 |
| 4,171,964 | A | 10/1979 | Campbell et al. | 62/621 |
| 4,185,978 | A | 1/1980 | McGalliard et al. | 62/634 |
| 4,251,249 | A | 2/1981 | Gulsby | 62/621 |
| 4,278,457 | A | 7/1981 | Campbell et al. | 62/621 |
| 4,519,824 | A | 5/1985 | Huebel | 62/621 |
| 4,617,039 | A | 10/1986 | Buck | 62/621 |
| 4,687,499 | A | 8/1987 | Aghili | 62/621 |
| 4,689,063 | A | 8/1987 | Paradowski et al. | 62/627 |
| 4,690,702 | A | 9/1987 | Paradowski et al. | 62/621 |
| 4,854,955 | A | 8/1989 | Campbell et al. | 62/621 |
| 4,869,740 | A | 9/1989 | Campbell et al. | 62/621 |
| 4,889,545 | A | 12/1989 | Campbell et al. | 62/621 |
| 5,114,451 | A | 5/1992 | Rambo et al. | 62/623 |
| 5,275,005 | A | 1/1994 | Campbell et al. | 62/621 |
| 5,555,748 | A | 9/1996 | Campbell et al. | 62/621 |
| 5,566,554 | A | 10/1996 | Vijayaraghavan et al. | 62/621 |
| 5,568,737 | A | 10/1996 | Campbell et al. | 62/621 |
| 5,771,712 | A | 6/1998 | Campbell et al. | 62/621 |
| 5,799,507 | A | 9/1998 | Wilkinson et al. | 62/621 |
| 5,881,569 | A | 3/1999 | Campbell et al. | 62/621 |
| 5,890,378 | A | 4/1999 | Rambo et al. | 62/621 |
| 5,983,664 | A | 11/1999 | Campbell et al. | 62/621 |
| 6,182,469 | B1 | 2/2001 | Campbell et al. | 62/621 |
| 6,578,379 | B2 | 6/2003 | Paradowski | 62/622 |
| 6,604,380 | B1 | 8/2003 | Reddick et al. | 62/620 |
| 6,712,880 | B2 | 3/2004 | Foglietta et al. | 95/184 |
| 6,907,752 | B2 | 6/2005 | Schroeder et al. | 62/620 |
| 6,915,662 | B2 | 7/2005 | Wilkinson et al. | 62/621 |
| 6,941,771 | B2 | 9/2005 | Reddick et al. | 62/620 |
| 7,069,743 | B2 | 7/2006 | Prim | 62/620 |
| 7,155,931 | B2 | 1/2007 | Wilkinson et al. | 62/620 |
| 7,191,617 | B2 | 3/2007 | Cuellar et al. | 62/628 |
| 7,216,507 | B2 | 5/2007 | Cuellar et al. | 62/620 |
| 7,219,513 | B1 | 5/2007 | Mostafa | 62/620 |
| 7,631,516 | B2 | 12/2009 | Cuellar et al. | 62/620 |
| 2006/0283207 | A1 | 12/2006 | Pitman et al. | 62/620 |
| 2008/0078205 | A1 | 4/2008 | Cuellar et al. | 62/620 |
| 2008/0190136 | A1 | 8/2008 | Pitman et al. | 62/620 |
| 2008/0282731 | A1 | 11/2008 | Cuellar et al. | 62/620 |
| 2009/0100862 | A1 | 4/2009 | Wilkinson et al. | 62/620 |
| 2010/0236285 | A1 | 9/2010 | Johnke et al. | 62/620 |
| 2010/0251764 | A1 | 10/2010 | Johnke et al. | 62/620 |
| 2010/0275647 | A1 | 11/2010 | Johnke et al. | 62/620 |
| 2010/0287982 | A1 | 11/2010 | Martinez et al. | 62/620 |
| 2010/0287983 | A1 | 11/2010 | Johnke et al. | 62/620 |
| 2010/0287984 | A1 | 11/2010 | Johnke et al. | 62/620 |

HYDROCARBON GAS PROCESSING FEATURING A COMPRESSED REFLUX STREAM FORMED BY COMBINING A PORTION OF COLUMN RESIDUE GAS WITH A DISTILLATION VAPOR STREAM WITHDRAWN FROM THE SIDE OF THE COLUMN

This invention relates to a process and an apparatus for the separation of a gas containing hydrocarbons. The applicants claim the benefits under Title 35, United States Code, Section 119(e) of prior U.S. Provisional Applications No. 61/244,181 which was filed on Sep. 21, 2009, No. 61/346,150 which was filed on May 19, 2010, and No. 61/351,045 which was filed on Jun. 3, 2010.

BACKGROUND OF THE INVENTION

Ethylene, ethane, propylene, propane, and/or heavier hydrocarbons can be recovered from a variety of gases, such as natural gas, refinery gas, and synthetic gas streams obtained from other hydrocarbon materials such as coal, crude oil, naphtha, oil shale, tar sands, and lignite. Natural gas usually has a major proportion of methane and ethane, i.e., methane and ethane together comprise at least 50 mole percent of the gas. The gas also contains relatively lesser amounts of heavier hydrocarbons such as propane, butanes, pentanes, and the like, as well as hydrogen, nitrogen, carbon dioxide, and other gases.

The present invention is generally concerned with the recovery of ethylene, ethane, propylene, propane and heavier hydrocarbons from such gas streams. A typical analysis of a gas stream to be processed in accordance with this invention would be, in approximate mole percent, 90.5% methane, 4.1% ethane and other $C_2$ components, 1.3% propane and other $C_3$ components, 0.4% iso-butane, 0.3% normal butane, and 0.5% pentanes plus, with the balance made up of nitrogen and carbon dioxide. Sulfur containing gases are also sometimes present.

The historically cyclic fluctuations in the prices of both natural gas and its natural gas liquid (NGL) constituents have at times reduced the incremental value of ethane, ethylene, propane, propylene, and heavier components as liquid products. This has resulted in a demand for processes that can provide more efficient recoveries of these products, for processes that can provide efficient recoveries with lower capital investment, and for processes that can be easily adapted or adjusted to vary the recovery of a specific component over a broad range. Available processes for separating these materials include those based upon cooling and refrigeration of gas, oil absorption, and refrigerated oil absorption. Additionally, cryogenic processes have become popular because of the availability of economical equipment that produces power while simultaneously expanding and extracting heat from the gas being processed. Depending upon the pressure of the gas source, the richness (ethane, ethylene, and heavier hydrocarbons content) of the gas, and the desired end products, each of these processes or a combination thereof may be employed.

The cryogenic expansion process is now generally preferred for natural gas liquids recovery because it provides maximum simplicity with ease of startup, operating flexibility, good efficiency, safety, and good reliability. U.S. Pat. Nos. 3,292,380; 4,061,481; 4,140,504; 4,157,904; 4,171,964; 4,185,978; 4,251,249; 4,278,457; 4,519,824; 4,617,039; 4,687,499; 4,689,063; 4,690,702; 4,854,955; 4,869,740; 4,889,545; 5,275,005; 5,555,748; 5,566,554; 5,568,737; 5,771,712; 5,799,507; 5,881,569; 5,890,378; 5,983,664; 6,182,469; 6,578,379; 6,712,880; 6,915,662; 7,191,617; 7,219,513; reissue U.S. Pat. No. 33,408; and co-pending application Ser. Nos. 11/430,412; 11/839,693; 11/971,491; 12/206,230; 12/689,616; 12/717,394; 12/750,862; 12/772,472; and 12/781,259 describe relevant processes (although the description of the present invention in some cases is based on different processing conditions than those described in the cited U.S. patents).

In a typical cryogenic expansion recovery process, a feed gas stream under pressure is cooled by heat exchange with other streams of the process and/or external sources of refrigeration such as a propane compression-refrigeration system. As the gas is cooled, liquids may be condensed and collected in one or more separators as high-pressure liquids containing some of the desired $C_2$+ components. Depending on the richness of the gas and the amount of liquids formed, the high-pressure liquids may be expanded to a lower pressure and fractionated. The vaporization occurring during expansion of the liquids results in further cooling of the stream. Under some conditions, pre-cooling the high pressure liquids prior to the expansion may be desirable in order to further lower the temperature resulting from the expansion. The expanded stream, comprising a mixture of liquid and vapor, is fractionated in a distillation (demethanizer or deethanizer) column. In the column, the expansion cooled stream(s) is (are) distilled to separate residual methane, nitrogen, and other volatile gases as overhead vapor from the desired $C_2$ components, $C_3$ components, and heavier hydrocarbon components as bottom liquid product, or to separate residual methane, $C_2$ components, nitrogen, and other volatile gases as overhead vapor from the desired $C_3$ components and heavier hydrocarbon components as bottom liquid product.

If the feed gas is not totally condensed (typically it is not), the vapor remaining from the partial condensation can be split into two streams. One portion of the vapor is passed through a work expansion machine or engine, or an expansion valve, to a lower pressure at which additional liquids are condensed as a result of further cooling of the stream. The pressure after expansion is essentially the same as the pressure at which the distillation column is operated. The combined vapor-liquid phases resulting from the expansion are supplied as feed to the column.

The remaining portion of the vapor is cooled to substantial condensation by heat exchange with other process streams, e.g., the cold fractionation tower overhead. Some or all of the high-pressure liquid may be combined with this vapor portion prior to cooling. The resulting cooled stream is then expanded through an appropriate expansion device, such as an expansion valve, to the pressure at which the demethanizer is operated. During expansion, a portion of the liquid will vaporize, resulting in cooling of the total stream. The flash expanded stream is then supplied as top feed to the demethanizer. Typically, the vapor portion of the flash expanded stream and the demethanizer overhead vapor combine in an upper separator section in the fractionation tower as residual methane product gas. Alternatively, the cooled and expanded stream may be supplied to a separator to provide vapor and liquid streams. The vapor is combined with the tower overhead and the liquid is supplied to the column as a top column feed.

In the ideal operation of such a separation process, the residue gas leaving the process will contain substantially all of the methane in the feed gas with essentially none of the heavier hydrocarbon components, and the bottoms fraction leaving the demethanizer will contain substantially all of the heavier hydrocarbon components with essentially no methane or more volatile components. In practice, however, this ideal situation is not obtained because the conventional demethanizer is operated largely as a stripping column. The methane product of the process, therefore, typically comprises vapors leaving the top fractionation stage of the column, together with vapors not subjected to any rectification step. Considerable losses of $C_2$, $C_3$, and $C_4$+ components occur because the top liquid feed contains substantial quantities of these components and heavier hydrocarbon components, resulting in corresponding equilibrium quantities of $C_2$ components, $C_3$ components, $C_4$ components, and heavier hydrocarbon components in the vapors leaving the top fractionation stage of the demethanizer. The loss of these desirable components could be significantly reduced if the rising vapors could be brought into contact with a significant quantity of liquid (reflux) capable of absorbing the $C_2$ components, $C_3$ components, $C_4$ components, and heavier hydrocarbon components from the vapors.

In recent years, the preferred processes for hydrocarbon separation use an upper absorber section to provide additional rectification of the rising vapors. The source of the reflux stream for the upper rectification section is typically a recycled stream of residue gas supplied under pressure. The recycled residue gas stream is usually cooled to substantial condensation by heat exchange with other process streams, e.g., the cold fractionation tower overhead. The resulting substantially condensed stream is then expanded through an appropriate expansion device, such as an expansion valve, to the pressure at which the demethanizer is operated. During expansion, a portion of the liquid will usually vaporize, resulting in cooling of the total stream. The flash expanded stream is then supplied as top feed to the demethanizer. Typically, the vapor portion of the expanded stream and the demethanizer overhead vapor combine in an upper separator section in the fractionation tower as residual methane product gas. Alternatively, the cooled and expanded stream may be supplied to a separator to provide vapor and liquid streams, so that thereafter the vapor is combined with the tower overhead and the liquid is supplied to the column as a top column feed. Typical process schemes of this type are disclosed in U.S. Pat. Nos. 4,889,545; 5,568,737; and 5,881,569, assignee's co-pending application Ser. No. 12/717,394, and in Mowrey, E. Ross, "Efficient, High Recovery of Liquids from Natural Gas Utilizing a High Pressure Absorber", Proceedings of the Eighty-First Annual Convention of the Gas Processors Association, Dallas, Tex., Mar. 11-13, 2002. These processes use a compressor to provide the motive force for recycling the reflux stream to the demethanizer, adding to both the capital cost and the operating cost of facilities using these processes.

The present invention also employs an upper rectification section (or a separate rectification column if plant size or other factors favor using separate rectification and stripping columns). However, the reflux stream for this rectification section is provided by using a side draw of the vapors rising in a lower portion of the tower combined with a portion of the column overhead vapor. Because of the relatively high concentration of $C_2$ components in the vapors lower in the tower, a significant quantity of liquid can be condensed from this combined vapor stream with only a modest elevation in pressure, using the refrigeration available in the remaining portion of the cold overhead vapor leaving the upper rectification section of the column to provide most of the cooling. This condensed liquid, which is predominantly liquid methane, can then be used to absorb $C_2$ components, $C_3$ components, $C_4$ components, and heavier hydrocarbon components from the vapors rising through the upper rectification section and thereby capture these valuable components in the bottom liquid product from the demethanizer.

Heretofore, compressing either a portion of the cold overhead vapor stream or compressing a side draw vapor stream to provide reflux for the upper rectification section of the column has been employed in $C_2$+ recovery systems, as illustrated in assignee's U.S. Pat. No. 4,889,545 and assignee's co-pending application Ser. No. 11/839,693, respectively. Surprisingly, applicants have found that combining a portion of the cold overhead vapor with the side draw vapor stream and then compressing the combined stream improves the system efficiency while reducing operating cost.

In accordance with the present invention, it has been found that $C_2$ recovery in excess of 84% and $C_3$ and $C_4$+ recoveries in excess of 99% can be obtained. In addition, the present invention makes possible essentially 100% separation of methane and lighter components from the $C_2$ components and heavier components at lower energy requirements compared to the prior art while maintaining the recovery levels. The present invention, although applicable at lower pressures and warmer temperatures, is particularly advantageous when processing feed gases in the range of 400 to 1500 psia [2,758 to 10,342 kPa(a)] or higher under conditions requiring NGL recovery column overhead temperatures of −50° F. [−46° C.] or colder.

For a better understanding of the present invention, reference is made to the following examples and drawings. Referring to the drawings.

In the following explanation of the above figures, tables are provided summarizing flow rates calculated for representative process conditions. In the tables appearing herein, the values for flow rates (in moles per hour) have been rounded to the nearest whole number for convenience. The total stream rates shown in the tables include all non-hydrocarbon components and hence are generally larger than the sum of the stream flow rates for the hydrocarbon components. Temperatures indicated are approximate values rounded to the nearest degree. It should also be noted that the process design calculations performed for the purpose of comparing the processes depicted in the figures are based on the assumption of no heat leak from (or to) the surroundings to (or from) the process. The quality of commercially available insulating materials makes this a very reasonable assumption and one that is typically made by those skilled in the art.

For convenience, process parameters are reported in both the traditional British units and in the units of the Système International d'Unités (SI). The molar flow rates given in the tables may be interpreted as either pound moles per hour or kilogram moles per hour. The energy consumptions reported as horsepower (HP) and/or thousand British Thermal Units per hour (MBTU/Hr) correspond to the stated molar flow rates in pound moles per hour. The energy consumptions reported as kilowatts (kW) correspond to the stated molar flow rates in kilogram moles per hour.

DESCRIPTION OF THE PRIOR ART

Figure 1:
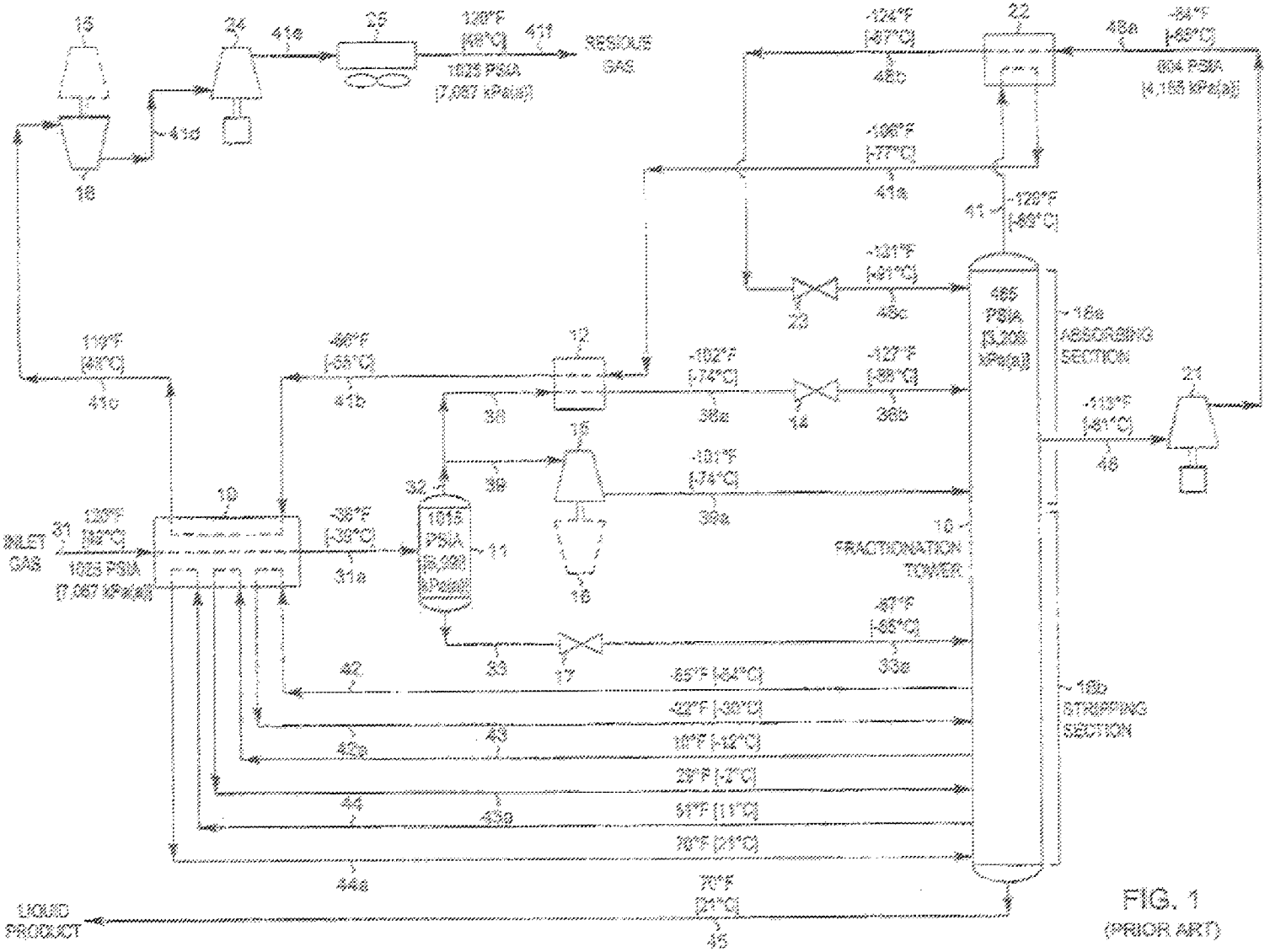
FIG. 1 (PRIOR ART)
FIG. 1 is a flow diagram of a prior art natural gas processing plant in accordance with assignee's co-pending application Ser. No. 11/839,693.

FIG. 1 is a process flow diagram showing the design of a processing plant to recover $C_2$+ components from natural gas using prior art according to assignee's co-pending application Ser. No. 11/839,693. In this simulation of the process, inlet gas enters the plant at 120° F. [49° C.] and 1025 psia [7,067 kPa(a)] as stream 31. If the inlet gas contains a concentration of sulfur compounds which would prevent the product streams from meeting specifications, the sulfur compounds are removed by appropriate pretreatment of the feed gas (not illustrated). In addition, the feed stream is usually dehydrated to prevent hydrate (ice) formation under cryogenic conditions. Solid desiccant has typically been used for this purpose.

The feed stream 31 is cooled in heat exchanger 10 by heat exchange with cool residue gas (stream 41*b*), demethanizer reboiler liquids at 51° F. [11° C.] (stream 44), demethanizer lower side reboiler liquids at 10° F. [−12° C.] (stream 43), and demethanizer upper side reboiler liquids at −65° F. [−54° C.] (stream 42). Note that in all cases exchanger 10 is representative of either a multitude of individual heat exchangers or a single multi-pass heat exchanger, or any combination thereof. (The decision as to whether to use more than one heat exchanger for the indicated cooling services will depend on a number of factors including, but not limited to, inlet gas flow rate, heat exchanger size, stream temperatures, etc.) The cooled stream 31*a* enters separator 11 at −38° F. [−39° C.] and 1015 psia [6,998 kPa(a)] where the vapor (stream 32) is separated from the condensed liquid (stream 33). The separator liquid (stream 33) is expanded to the operating pressure (approximately 465 psia [3,208 kPa(a)]) of fractionation tower 18 by expansion valve 17, cooling stream 33*a* to −67° F. [−55° C.] before it is supplied to fractionation tower 18 at a lower mid-column feed point.

The vapor (stream 32) from separator 11 is divided into two streams, 36 and 39. Stream 36, containing about 23% of the total vapor, passes through heat exchanger 12 in heat exchange relation with the cold residue gas (stream 41*a*) where it is cooled to substantial condensation. The resulting substantially condensed stream 36*a* at −102° F. [−74° C.] is then flash expanded through expansion valve 14 to slightly above the operating pressure of fractionation tower 18. During expansion a portion of the stream is vaporized, resulting in cooling of the total stream. In the process illustrated in FIG. 1, the expanded stream 36*b* leaving expansion valve 14 reaches a temperature of −127° F. [−88° C.] before it is supplied at an upper mid-column feed point, in absorbing section 18*a* of fractionation tower 18.

The remaining 77% of the vapor from separator 11 (stream 39) enters a work expansion machine 15 in which mechanical energy is extracted from this portion of the high pressure feed. The machine 15 expands the vapor substantially isentropically to the tower operating pressure, with the work expansion cooling the expanded stream 39*a* to a temperature of approximately −101° F. [−74° C.]. The typical commercially available expanders are capable of recovering on the order of 80-85% of the work theoretically available in an ideal isentropic expansion. The work recovered is often used to drive a centrifugal compressor (such as item 16) that can be used to re-compress the residue gas (stream 41*c*), for example. The partially condensed expanded stream 39*a* is thereafter supplied as feed to fractionation tower 18 at a mid-column feed point.

The demethanizer in tower 18 is a conventional distillation column containing a plurality of vertically spaced trays, one or more packed beds, or some combination of trays and packing. The demethanizer tower consists of two sections: an upper absorbing (rectification) section 18*a* that contains the trays and/or packing to provide the necessary contact between the vapor portions of the expanded streams 36*b* and 39*a* rising upward and cold liquid falling downward to condense and absorb the $C_2$ components, $C_3$ components, and heavier components; and a lower, stripping section 18*b* that contains the trays and/or packing to provide the necessary contact between the liquids falling downward and the vapors rising upward. The demethanizing section 18*b* also includes one or more reboilers (such as the reboiler and side reboilers described previously) which heat and vaporize a portion of the liquids flowing down the column to provide the stripping vapors which flow up the column to strip the liquid product, stream 45, of methane and lighter components. Stream 39*a* enters demethanizer 18 at an intermediate feed position located in the lower region of absorbing section 18*a* of demethanizer 18. The liquid portion of the expanded stream 39*a* comingles with liquids falling downward from absorbing section 18*a* and the combined liquid continues downward into stripping section 18*b* of demethanizer 18. The vapor portion of the expanded stream 39*a* rises upward through absorbing section 18*a* and is contacted with cold liquid falling downward to condense and absorb the $C_2$ components, $C_3$ components, and heavier components.

A portion of the distillation vapor (stream 48) is withdrawn from an intermediate region of absorbing section 18*a* in fractionation column 18, above the feed position of expanded stream 39*a* and below the feed position of expanded stream 36*b*. The distillation vapor stream 48 at −113° F. [−81° C.] is compressed to 604 psia [4,165 kPa(a)] (stream 48*a*) by reflux compressor 21, then cooled from −84° F. [−65° C.] to −124° F. [−87° C.] and substantially condensed (stream 48*b*) in heat exchanger 22 by heat exchange with cold residue gas stream 41, the overhead stream exiting the top of demethanizer 18. The substantially condensed stream 48*b* is then expanded through an appropriate expansion device, such as expansion valve 23, to the demethanizer operating pressure, resulting in cooling of the total stream to −131° F. [−91° C.]. The expanded stream 48*c* is then supplied to fractionation tower 18 as the top column feed. The vapor portion of stream 48*c* combines with the vapors rising from the top fractionation stage of the column to form demethanizer overhead stream 41 at −128° F. [−89° C.].

The liquid product (stream 45) exits the bottom of tower 18 at 70° F. [21° C.], based on a typical specification of a methane to ethane ratio of 0.025:1 on a molar basis in the bottom product. The cold residue gas stream 41 passes countercurrently to the compressed distillation vapor stream in heat exchanger 22 where it is heated to −106° F. [−77° C.] (stream 41*a*), and countercurrently to the incoming feed gas in heat exchanger 12 where it is heated to −66° F. [−55° C.] (stream 41*b*) and in heat exchanger 10 where it is heated to 110° F. [43° C.] (stream 41*c*). The residue gas is then re-compressed in two stages. The first stage is compressor 16 driven by expansion machine 15. The second stage is compressor 24 driven by a supplemental power source which compresses the residue gas (stream 41*e*) to sales line pressure. After cooling to 120° F. [49° C.] in discharge cooler 25, the residue gas product (stream 41*f*) flows to the sales gas pipeline at 1025 psia [7,067 kPa(a)], sufficient to meet line requirements (usually on the order of the inlet pressure).

A summary of stream flow rates and energy consumption for the process illustrated in FIG. 1 is set forth in the following table:

TABLE I (FIG. 1)

Stream Flow Summary - Lb. Moles/Hr [kg moles/Hr]

| Stream | Methane | Ethane | Propane | Butanes+ | Total |
|---|---|---|---|---|---|
| 31 | 25,382 | 1,161 | 362 | 332 | 28,055 |
| 32 | 25,050 | 1,096 | 311 | 180 | 27,431 |
| 33 | 332 | 65 | 51 | 152 | 624 |
| 36 | 5,636 | 247 | 70 | 40 | 6,172 |
| 39 | 19,414 | 849 | 241 | 140 | 21,259 |
| 48 | 3,962 | 100 | 3 | 0 | 4,200 |
| 41 | 25,358 | 197 | 2 | 0 | 26,056 |
| 45 | 24 | 964 | 360 | 332 | 1,999 |

Recoveries*

| | |
|---|---|
| Ethane | 83.06% |
| Propane | 99.50% |
| Butanes+ | 99.98% |

Power

| | | |
|---|---|---|
| Residue Gas Compression | 10,783 HP | [17,727 kW] |
| Recycle Compression | 260 HP | [427 kW] |
| Total Compression | 11,043 HP | [18,154 kW] |

*(Based on un-rounded flow rates)

DESCRIPTION OF THE INVENTION

Figure 2:
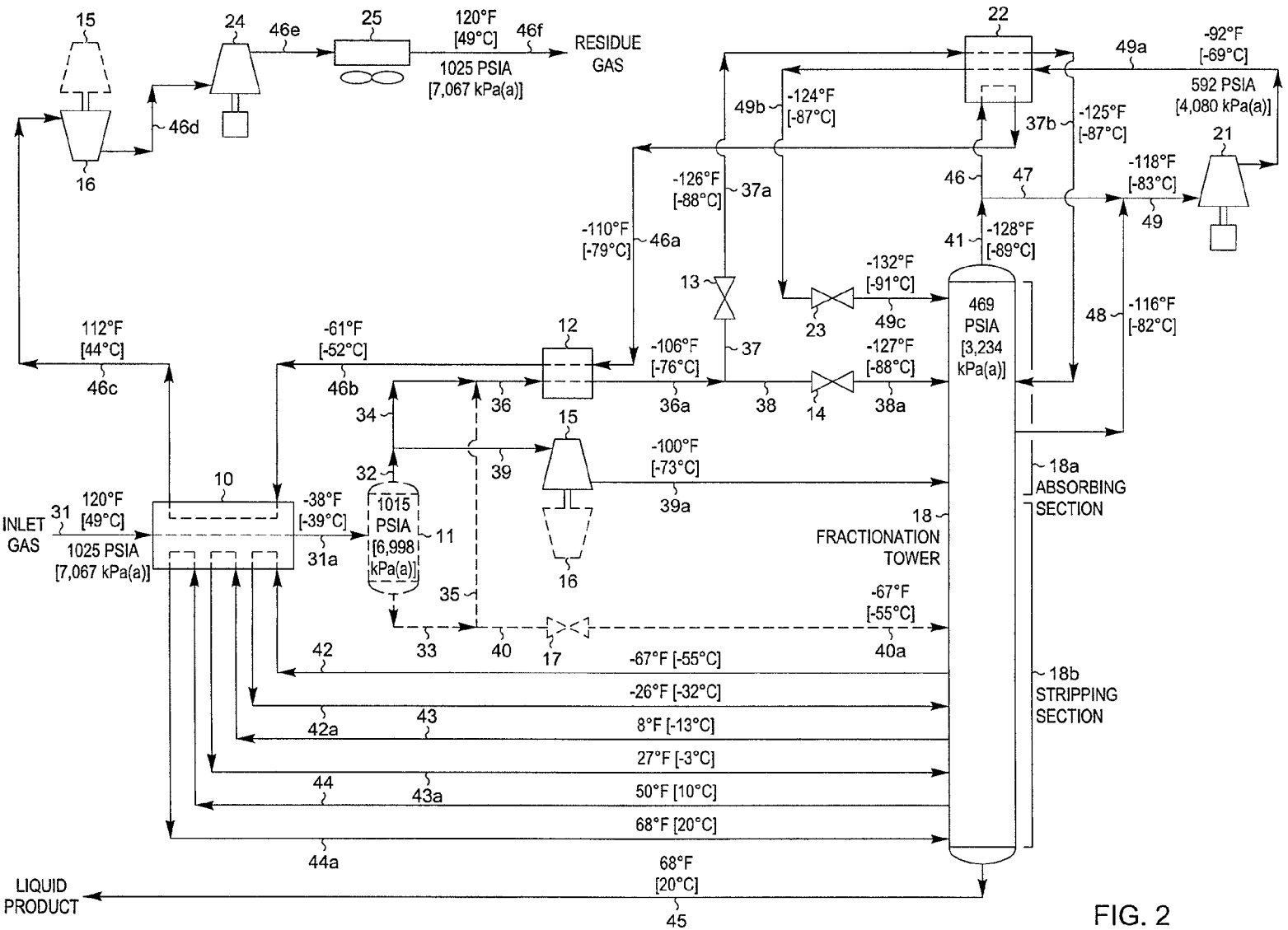
FIG. 2 is a flow diagram of a natural gas processing plant in accordance with the present invention.

FIG. 2 illustrates a flow diagram of a process in accordance with the present invention. The feed gas composition and conditions considered in the process presented in FIG. 2 are the same as those in FIG. 1. Accordingly, the FIG. 2 process can be compared with that of the FIG. 1 process to illustrate the advantages of the present invention.

In the simulation of the FIG. 2 process, inlet gas enters the plant at 120° F. [49° C.] and 1025 psia [7,067 kPa(a)] as stream 31 and is cooled in heat exchanger 10 by heat exchange with cool residue gas (stream 46*b*), demethanizer reboiler liquids at 50° F. [10° C.] (stream 44), demethanizer lower side reboiler liquids at 8° F. [−13° C.] (stream 43), and demethanizer upper side reboiler liquids at −67° F. [−55° C.] (stream 42). The cooled stream 31*a* enters separator 11 at −38° F. [−39° C.] and 1015 psia [6,998 kPa(a)] where the vapor (stream 32) is separated from the condensed liquid (stream 33). The separator liquid (stream 33/40) is expanded to the operating pressure (approximately 469 psia [3,234 kPa(a)]) of fractionation tower 18 by expansion valve 17, cooling stream 40*a* to −67° F. [−55° C.] before it is supplied to fractionation tower 18 at a lower mid-column feed point (located below the feed point of stream 39*a* described below).

The vapor (stream 32) from separator 11 is divided into two streams, 34 and 39. Stream 34, containing about 26% of the total vapor, passes through heat exchanger 12 in heat exchange relation with the cold residue gas (stream 46*a*) where it is cooled to substantial condensation. The resulting substantially condensed stream 36*a* at −106° F. [−76° C.] is then divided into two portions, streams 37 and 38. Stream 38, containing about 50.5% of the total substantially condensed stream, is flash expanded through expansion valve 14 to the operating pressure of fractionation tower 18. During expansion a portion of the stream is vaporized, resulting in cooling of the total stream. In the process illustrated in FIG. 2, the expanded stream 38*a* leaving expansion valve 14 reaches a temperature of −127° F. [−88° C.] before it is supplied at an upper mid-column feed point, in absorbing section 18*a* of fractionation tower 18. The remaining 49.5% of the substantially condensed stream (stream 37) is flash expanded through expansion valve 13 to slightly above the operating pressure of fractionation tower 18. The flash expanded stream 37*a* is warmed slightly in heat exchanger 22 from −126° F. [−88° C.] to −125° F.

[−87° C.], and the resulting stream 37*b* is then supplied at another upper mid-column feed point in absorbing section 18*a* of fractionation tower 18.

The remaining 74% of the vapor from separator 11 (stream 39) enters a work expansion machine 15 in which mechanical energy is extracted from this portion of the high pressure feed. The machine 15 expands the vapor substantially isentropically to the tower operating pressure, with the work expansion cooling the expanded stream 39*a* to a temperature of approximately −100° F. [−73° C.]. The partially condensed expanded stream 39*a* is thereafter supplied as feed to fractionation tower 18 at a mid-column feed point (located below the feed points of streams 38*a* and 37*b*).

The demethanizer in tower 18 is a conventional distillation column containing a plurality of vertically spaced trays, one or more packed beds, or some combination of trays and packing. The demethanizer tower consists of two sections: an upper absorbing (rectification) section 18*a* that contains the trays and/or packing to provide the necessary contact between the vapor portion of the expanded streams 38*a* and 39*a* and heated expanded stream 37*b* rising upward and cold liquid falling downward to condense and absorb the $C_2$ components, $C_3$ components, and heavier components from the vapors rising upward; and a lower, stripping section 18*b* that contains the trays and/or packing to provide the necessary contact between the liquids falling downward and the vapors rising upward. The demethanizing section 18*b* also includes one or more reboilers (such as the reboiler and side reboilers described previously) which heat and vaporize a portion of the liquids flowing down the column to provide the stripping vapors which flow up the column to strip the liquid product, stream 45, of methane and lighter components. Stream 39*a* enters demethanizer 18 at an intermediate feed position located in the lower region of absorbing section 18*a* of demethanizer 18. The liquid portion of the expanded stream comingles with liquids falling downward from absorbing section 18*a* and the combined liquid continues downward into stripping section 18*b* of demethanizer 18. The vapor portion of the expanded stream comingles with vapors arising from stripping section 18*b* and the combined vapor rises upward through absorbing section 18*a* and is contacted with cold liquid falling downward to condense and absorb the $C_2$ components, $C_3$ components, and heavier components.

A portion of the distillation vapor (stream 48) is withdrawn from an intermediate region of absorbing section 18*a* in fractionation column 18, above the feed position of expanded stream 39*a* in the lower region of absorbing section 18*a* and below the feed positions of expanded stream 38*a* and heated expanded stream 37*b*. The distillation vapor stream 48 at −116° F. [−82° C.] is combined with a portion (stream 47) of overhead vapor stream 41 at −128° F. [−89° C.] to form combined vapor stream 49 at −118° F. [−83° C.]. The combined vapor stream 49 is compressed to 592 psia [4,080 kPa(a)] (stream 49*a*) by reflux compressor 21, then cooled from −92° F. [−69° C.] to −124° F. [−87° C.] and substantially condensed (stream 49*b*) in heat exchanger 22 by heat exchange with residue gas stream 46 (the remaining portion of cold demethanizer overhead stream 41 exiting the top of demethanizer 18) and with the flash expanded stream 37*a* as described previously. The cold residue gas stream is warmed to −110° F. [−79° C.] (stream 46*a*) as it provides cooling to the compressed combined vapor stream 49*a*.

The substantially condensed stream 49*b* is flash expanded to the operating pressure of demethanizer 18 by expansion valve 23. A portion of the stream is vaporized, further cooling stream 49*c* to −132° F. [−91° C.] before it is supplied as cold top column feed (reflux) to demethanizer 18. This cold liquid reflux absorbs and condenses the $C_2$ components, $C_3$ components, and heavier components rising in the upper rectification region of absorbing section 18*a* of demethanizer 18.

In stripping section 18*b* of demethanizer 18, the feed streams are stripped of their methane and lighter components. The resulting liquid product (stream 45) exits the bottom of tower 18 at 68° F. [20° C.] (based on a typical specification of a methane to ethane ratio of 0.025:1 on a molar basis in the bottom product). The partially warmed residue gas stream 46*a* passes countercurrently to the incoming feed gas in heat exchanger 12 where it is heated to −61° F. [−52° C.] (stream 46*b*) and in heat exchanger 10 where it is heated to 112° F. [44° C.] (stream 46*c*) as it provides cooling as previously described. The residue gas is then re-compressed in two stages, compressor 16 driven by expansion machine 15 and compressor 24 driven by a supplemental power source. After stream 46*e* is cooled to 120° F. [49° C.] in discharge cooler 25, the residue gas product (stream 461) flows to the sales gas pipeline at 1025 psia [7,067 kPa(a)], sufficient to meet line requirements (usually on the order of the inlet pressure).

A summary of stream flow rates and energy consumption for the process illustrated in FIG. 2 is set forth in the following table:

TABLE II (FIG. 2)

Stream Flow Summary - Lb. Moles/Hr [kg moles/Hr]

| Stream | Methane | Ethane | Propane | Butanes+ | Total |
|---|---|---|---|---|---|
| 31 | 25,382 | 1,161 | 362 | 332 | 28,055 |
| 32 | 25,050 | 1,096 | 310 | 180 | 27,431 |
| 33 | 332 | 65 | 52 | 152 | 624 |
| 34 | 6,563 | 287 | 81 | 47 | 7,187 |
| 35 | 0 | 0 | 0 | 0 | 0 |
| 36 | 6,563 | 287 | 81 | 47 | 7,187 |
| 37 | 3,249 | 142 | 40 | 23 | 3,558 |
| 38 | 3,314 | 145 | 41 | 24 | 3,629 |
| 39 | 18,487 | 809 | 229 | 133 | 20,244 |
| 40 | 332 | 65 | 52 | 152 | 624 |
| 41 | 25,874 | 178 | 1 | 0 | 26,534 |
| 47 | 517 | 4 | 0 | 0 | 531 |
| 48 | 3,801 | 79 | 2 | 0 | 4,000 |
| 49 | 4,318 | 83 | 2 | 0 | 4,531 |
| 46 | 25,357 | 174 | 1 | 0 | 26,003 |
| 45 | 25 | 987 | 361 | 332 | 2,052 |

Recoveries*

| | |
|---|---|
| Ethane | 84.98% |
| Propane | 99.67% |
| Butanes+ | 99.99% |

Power

| | | |
|---|---|---|
| Residue Gas Compression | 10,801 HP | [17,757 kW] |
| Reflux Compression | 241 HP | [396 kW] |
| Total Compression | 11,042 HP | [18,153 kW] |

*(Based on un-rounded flow rates)

A comparison of Tables I and II shows that, compared to the prior art, the present invention improves ethane recovery from 83.06% to 84.98%, propane recovery from 99.50% to 99.67%, and butanes+recovery from 99.98% to 99.99%. Comparison of Tables I and II further shows that the improvement in yields was achieved using essentially the same power as the prior art. In terms of the recovery efficiency (defined by the quantity of ethane recovered per unit of power), the present invention represents a 2% improvement over the prior art of the FIG. 1 process.

The improvement in the recovery efficiency of the present invention over that of the prior art processes can be understood by examining the improvement in the rectification that the present invention provides for the upper region of absorbing section 18*a*. Compared to the prior art of the FIG. 1 process, the present invention produces a better top reflux stream containing more methane and less $C_2$+ components. Comparing reflux stream 48 in Table I for the FIG. 1 prior art process with reflux stream 49 in Table II for the present invention, it can be seen that the present invention provides a reflux stream that is greater in quantity (nearly 8%) with a significantly lower concentration of $C_2$+ components (1.9% for the present invention versus 2.5% for the FIG. 1 prior art process). Further, because the present invention uses a portion of substantially condensed feed stream 36*a* (expanded stream 37*a*) to supplement the cooling provided by the residue gas (stream 46), the compressed reflux stream 49*a* can be substantially condensed at lower pressure, reducing the power required by reflux compressor 21 compared to the FIG. 1 prior art process even though the reflux flow rate is higher for the present invention.

Unlike the prior art process of assignee's U.S. Pat. No. 4,889,545, the present invention uses only a portion of substantially condensed feed stream 36*a* (expanded stream 37*a*) to provide cooling to compressed reflux stream 49*a*. This allows the rest of substantially condensed feed stream 36*a* (expanded stream 38*a*) to provide bulk recovery of the $C_2$ components, $C_3$ components, and heavier hydrocarbon components contained in expanded feed 39*a* and the vapors rising from stripping section 18*b*. In the present invention, the cold residue gas (stream 46) is used to provide most of the cooling of compressed reflux stream 49*a*, reducing the heating of stream 37*a* compared to the prior art so that the resulting stream 37*b* can supplement the bulk recovery provided by expanded stream 38*a*. The supplemental rectification provided by reflux stream 49*c* can then reduce the amount of $C_2$ components, $C_3$ components, and $C_4$+ components contained in the inlet feed gas that is lost to the residue gas.

The present invention also reduces the rectification required from reflux stream 49*c* in absorbing section 18*a* compared to the prior art U.S. Pat. No. 4,889,545 process by condensing reflux stream 49*c* with less warming of the column feeds (streams 37*b*, 38*a*, and 39*a*) to absorbing section 18*a*. If all of the substantially condensed stream 36*a* is expanded and warmed to provide condensing as is taught in U.S. Pat. No. 4,889,545, not only is there less cold liquid in the resulting stream available for rectification of the vapors rising in absorbing section 18*a*, there is much more vapor in the upper region of absorbing section 18*a* that must be rectified by the reflux stream. The net result is that the reflux stream of the prior art U.S. Pat. No. 4,889,545 process allows more of the $C_2$ components to escape to the residue gas stream than the present invention does, reducing its recovery efficiency compared to the present invention. The key improvements of the present invention over the prior art U.S. Pat. No. 4,889,545 process are that the cold residue gas stream 46 is used to provide most of the cooling of compressed reflux stream 49*a* in heat exchanger 22, and that the distillation vapor stream 48 contains a significant fraction of $C_2$ components not found in the column overhead stream 41, allowing sufficient methane to be condensed for use as reflux without adding significant rectification load in absorbing section 18*a* due to the excessive vaporization of stream 36*a* that is inherent when it is expanded and heated as taught in the U.S. Pat. No. 4,889,545 prior art process.

Other Embodiments

In accordance with this invention, it is generally advantageous to design the absorbing (rectification) section of the demethanizer to contain multiple theoretical separation stages. However, the benefits of the present invention can be achieved with as few as two theoretical stages. For instance, all or a part of the expanded reflux stream (stream 49*c*) leaving expansion valve 23, all or a part of the expanded substantially condensed stream 38*a* from expansion valve 14, and all or a part of the heated expanded stream 37*b* leaving heat exchanger 22 can be combined (such as in the piping joining the expansion valves and heat exchanger to the demethanizer) and if thoroughly intermingled, the vapors and liquids will mix together and separate in accordance with the relative volatilities of the various components of the total combined streams. Such comingling of the three streams, combined with contacting at least a portion of expanded stream 39*a*, shall be considered for the purposes of this invention as constituting an absorbing section.

Figure 3:
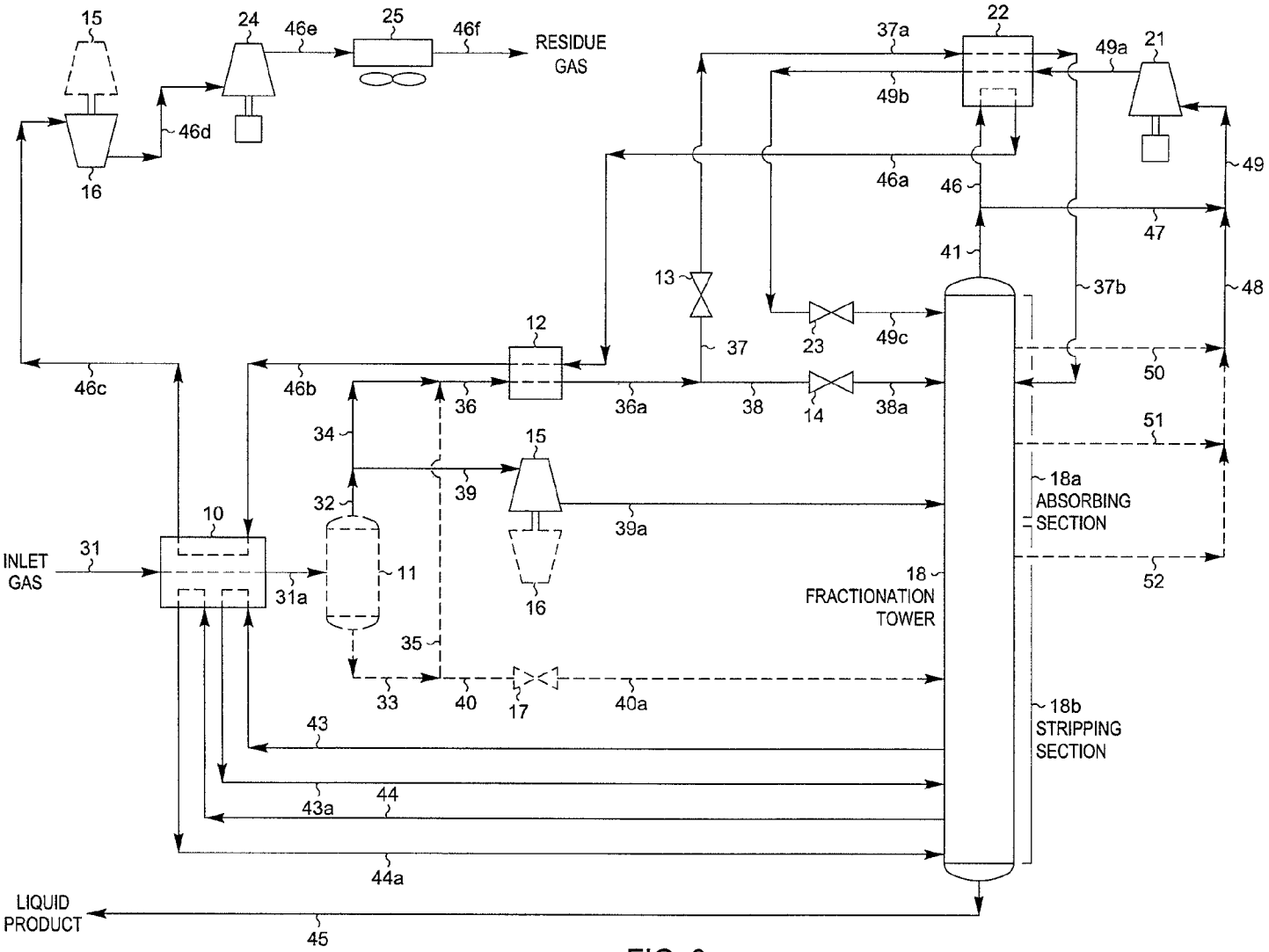
FIGS. 3 through 6 are flow diagrams illustrating alternative means of application of the present invention to a natural gas stream.
Figure 4:
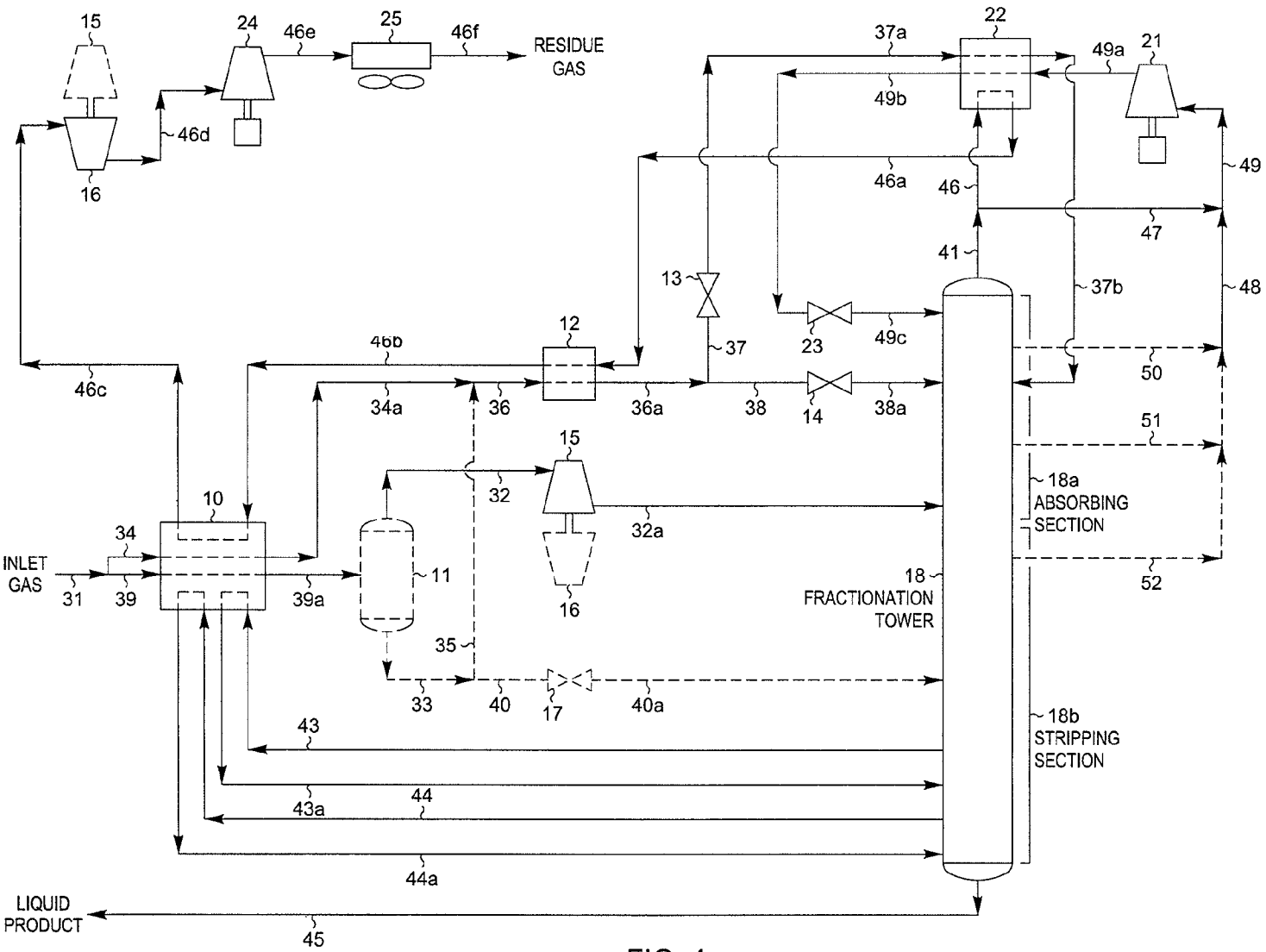
Figure 5:
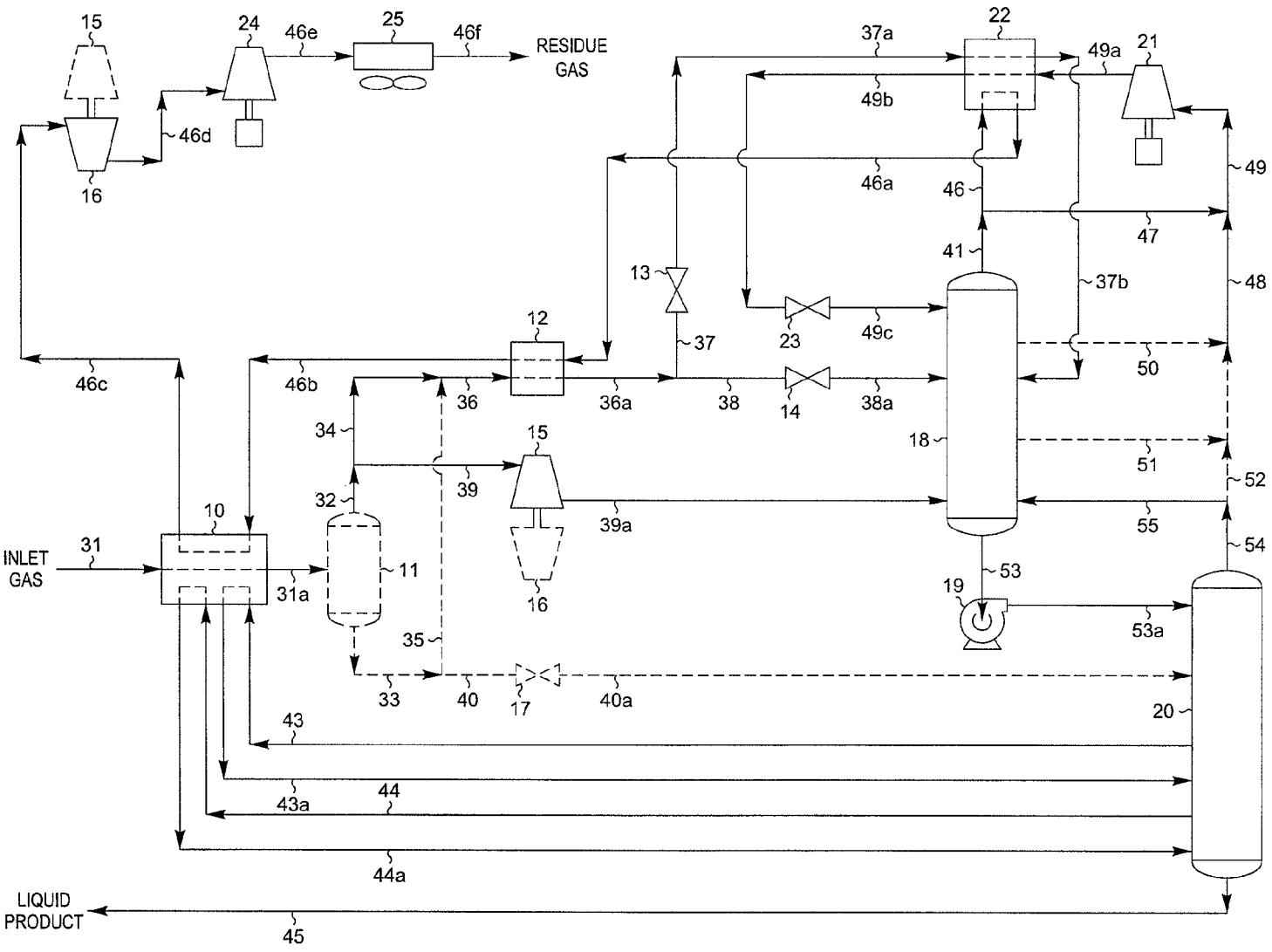
Figure 6:
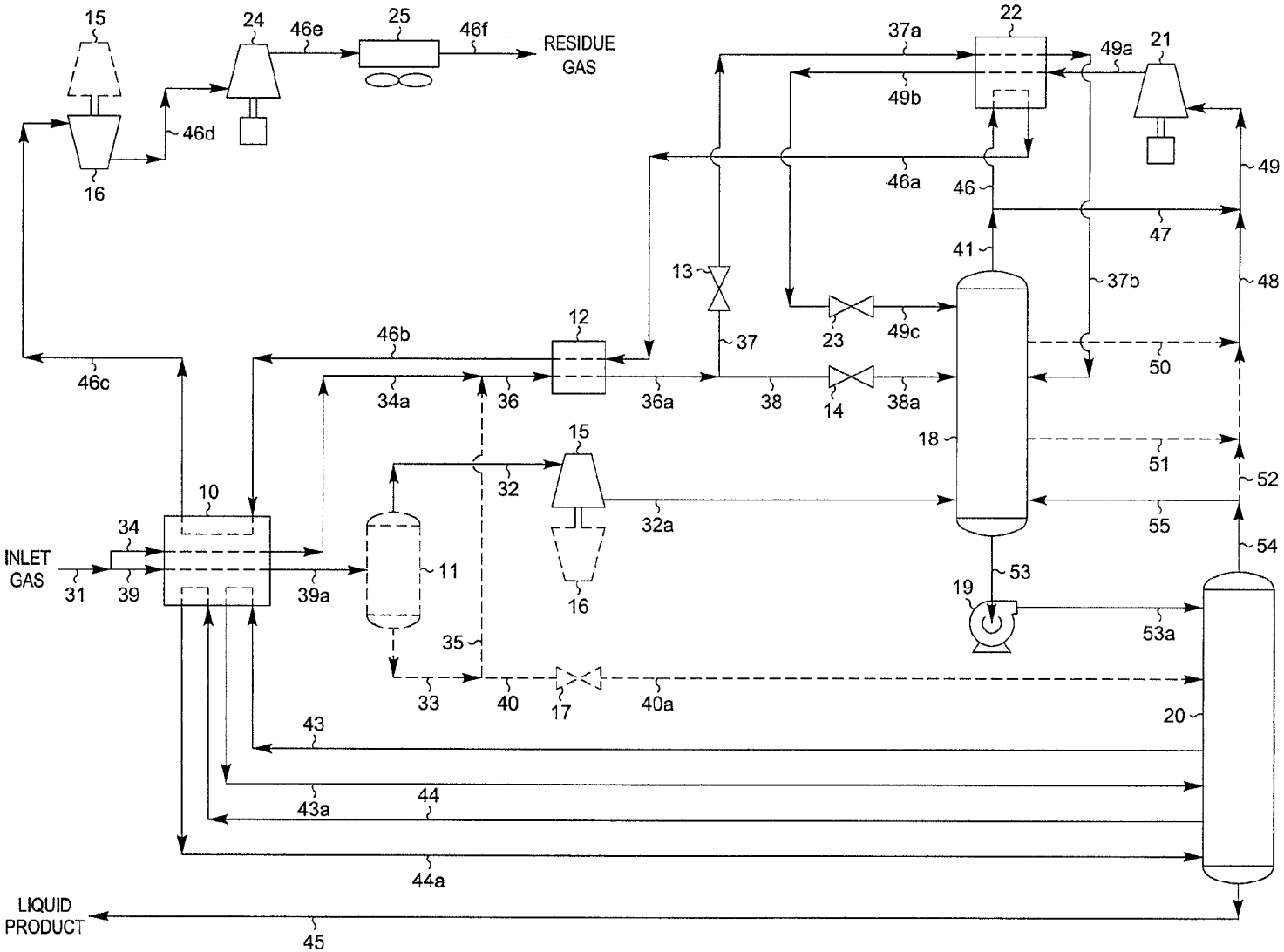

FIGS. 3 through 6 display other embodiments of the present invention. FIGS. 2 through 4 depict fractionation towers constructed in a single vessel. FIGS. 5 and 6 depict fractionation towers constructed in two vessels, absorber (rectifier) column 18 (a contacting and separating device) and stripper (distillation) column 20. In such cases, the overhead vapor stream 54 from stripper column 20 flows to the lower section of absorber column 18 (via stream 55) to be contacted by reflux stream 49*c*, expanded substantially condensed stream 38*a*, and heated expanded stream 37*b*. Pump 19 is used to route the liquids (stream 53) from the bottom of absorber column 18 to the top of stripper column 20 so that the two towers effectively function as one distillation system. The decision whether to construct the fractionation tower as a single vessel (such as demethanizer 18 in FIGS. 2 through 4) or multiple vessels will depend on a number of factors such as plant size, the distance to fabrication facilities, etc.

Some circumstances may favor withdrawing the distillation vapor stream 48 in FIGS. 3 and 4 from the upper region of absorbing section 18*a* (stream 50) above the feed point of expanded substantially condensed stream 38*a*, rather than from the intermediate region of absorbing section 18*a* (stream 51) below the feed point of expanded substantially condensed stream 38*a*. Likewise in FIGS. 5 and 6, the vapor distillation stream 48 may be withdrawn from absorber column 18 above the feed point of expanded substantially condensed stream 38*a* (stream 50) or below the feed point of expanded substantially condensed stream 38*a* (stream 51). In other cases, it may be advantageous to withdraw the distillation vapor stream 48 from the upper region of stripping section 18*b* in demethanizer 18 (stream 52) in FIGS. 3 and 4. Similarly in FIGS. 5 and 6, a portion (stream 52) of overhead vapor stream 54 from stripper column 20 may be combined with stream 47 to form stream 49, with any remaining portion (stream 55) flowing to the lower section of absorber column 18.

As described earlier, the compressed combined vapor stream 49*a* is substantially condensed and the resulting condensate used to absorb valuable $C_2$ components, $C_3$ components, and heavier components from the vapors rising through absorbing section 18*a* of demethanizer 18 or through absorber column 18. However, the present invention is not limited to this embodiment. It may be advantageous, for instance, to treat only a portion of these vapors in this manner, or to use only a portion of the condensate as an absorbent, in cases where other design considerations indicate portions of the vapors or the condensate should bypass absorbing section 18*a* of demethanizer 18 or absorber column 18. Some circumstances may favor partial condensation, rather than substantial condensation, of compressed combined vapor stream 49*a* in heat exchanger 22. Other circumstances may favor that distillation vapor stream 48 be a total vapor side draw from fractionation column 18 or absorber column 18 rather than a partial vapor side draw. It should also be noted that, depending on the composition of the feed gas stream, it may be advantageous to use external refrigeration to provide partial cooling of compressed combined vapor stream 49*a* in heat exchanger 22.

Feed gas conditions, plant size, available equipment, or other factors may indicate that elimination of work expansion machine 15, or replacement with an alternate expansion device (such as an expansion valve), is feasible. Although individual stream expansion is depicted in particular expansion devices, alternative expansion means may be employed where appropriate. For example, conditions may warrant work expansion of the substantially condensed portions of the feed stream (streams 37 and 38) or the substantially condensed reflux stream leaving heat exchanger 22 (stream 49*b*).

Depending on the quantity of heavier hydrocarbons in the feed gas and the feed gas pressure, the cooled feed stream 31*a* leaving heat exchanger 10 in FIGS. 2 through 6 may not contain any liquid (because it is above its dewpoint, or because it is above its cricondenbar). In such cases, separator 11 shown in FIGS. 2 through 6 is not required.

In accordance with the present invention, the splitting of the vapor feed may be accomplished in several ways. In the processes of FIGS. 2, 3, and 5, the splitting of vapor occurs following cooling and separation of any liquids which may have been formed. The high pressure gas may be split, however, prior to any cooling of the inlet gas as shown in FIGS. 4 and 6. In some embodiments, vapor splitting may be effected in a separator.

The high pressure liquid (stream 33 in FIGS. 2 through 6) need not be expanded and fed to a mid-column feed point on the distillation column. Instead, all or a portion of it may be combined with the portion of the separator vapor (stream 34 in FIGS. 2, 3, and 5) or the portion of the cooled feed gas (stream 34*a* in FIGS. 4 and 6) flowing to heat exchanger 12. (This is shown by the dashed stream 35 in FIGS. 2 through 6.) Any remaining portion of the liquid may be expanded through an appropriate expansion device, such as an expansion valve or expansion machine, and fed to a mid-column feed point on the distillation column (stream 40*a* in FIGS. 2 through 6). Stream 40 may also be used for inlet gas cooling or other heat exchange service before or after the expansion step prior to flowing to the demethanizer.

In accordance with the present invention, the use of external refrigeration to supplement the cooling available to the inlet gas from other process streams may be employed, particularly in the case of a rich inlet gas. The use and distribution of separator liquids and demethanizer side draw liquids for process heat exchange, and the particular arrangement of heat exchangers for inlet gas cooling must be evaluated for each particular application, as well as the choice of process streams for specific heat exchange services.

It will also be recognized that the relative amount of feed found in each branch of the split vapor feed will depend on several factors, including gas pressure, feed gas composition, the amount of heat which can economically be extracted from the feed, and the quantity of horsepower available. More feed to the top of the column may increase recovery while decreasing power recovered from the expander thereby increasing the recompression horsepower requirements. Increasing feed lower in the column reduces the horsepower consumption but may also reduce product recovery. The relative locations of the mid-column feeds may vary depending on inlet composition or other factors such as desired recovery levels and amount of liquid formed during inlet gas cooling. Moreover, two or more of the feed streams, or portions thereof, may be combined depending on the relative temperatures and quantities of individual streams, and the combined stream then fed to a mid-column feed position. For instance, circumstances may favor combining expanded substantially condensed stream 38*a* with heated expanded stream 37*b* and supplying the combined stream to a single upper mid-column feed point on fractionation tower 18 (FIGS. 2 through 4) or absorber column 18 (FIGS. 5 and 6).

The present invention provides improved recovery of $C_2$ components, $C_3$ components, and heavier hydrocarbon components or of $C_3$ components and heavier hydrocarbon components per amount of utility consumption required to operate the process. An improvement in utility consumption required for operating the demethanizer or deethanizer process may appear in the form of reduced power requirements for compression or re-compression, reduced power requirements for external refrigeration, reduced energy requirements for tower reboilers, or a combination thereof.

While there have been described what are believed to be preferred embodiments of the invention, those skilled in the art will recognize that other and further modifications may be made thereto, e.g. to adapt the invention to various conditions, types of feed, or other requirements without departing from the spirit of the present invention as defined by the following claims.

We claim:

1. In a process for the separation of a gas stream containing methane, $C_2$ components, $C_3$ components, and heavier hydrocarbon components into a volatile residue gas fraction and a relatively less volatile fraction containing a major portion of said $C_2$ components, $C_3$ components, and heavier hydrocarbon components or said $C_3$ components and heavier hydrocarbon components, in which process said gas stream is cooled under pressure to provide a cooled stream;

said cooled stream is expanded to a lower pressure whereby it is further cooled; and said further cooled stream is directed into a distillation column and fractionated at said lower pressure whereby the components of said relatively less volatile fraction are recovered;

the improvement wherein following cooling, said cooled stream is divided into first and second streams; and (1) said first stream is cooled to condense substantially all of it;

(2) said substantially condensed first stream is divided into at least a first condensed portion and a second condensed portion;

(3) said first condensed portion is expanded to said lower pressure whereby it is further cooled, and is thereafter supplied to said distillation column at an upper mid-column feed position;

(4) said second condensed portion is expanded to said lower pressure whereby it is further cooled, is heated, and is thereafter supplied to said distillation column at said upper mid-column feed position or at an additional mid-column feed position;

(5) said second stream is expanded to said lower pressure and is supplied to said distillation column at a mid-column feed position below said upper mid-column feed position;

(6) an overhead vapor stream is withdrawn from an upper region of said distillation column and divided into at least a first vapor portion and a second vapor portion;

(7) said second vapor portion is heated, thereafter discharging at least a portion of said heated second vapor portion as said volatile residue gas fraction;

(8) a distillation vapor stream is withdrawn from a region of said distillation column (a) above said upper mid-column feed position; or (b) below a top feed position and above said upper mid-column feed position; or (c) below said upper mid-column feed position and above said mid-column feed position; or (d) below said mid-column feed position;

and is combined with said first vapor portion to form a combined vapor stream;

(9) said combined vapor stream is compressed to higher pressure;

(10) said compressed combined vapor stream is cooled sufficiently to condense at least a part of it, thereby forming a condensed stream while supplying at least a portion of the heating of steps (4) and (7);

(11) at least a portion of said condensed stream is expanded to said lower pressure and is thereafter supplied to said distillation column at said top feed position; and

(12) the quantities and temperatures of said feed streams to said distillation column are effective to maintain the overhead temperature of said distillation column at a temperature whereby the major portions of the components in said relatively less volatile fraction are recovered.

2. The process according to claim 1 wherein said gas stream is cooled sufficiently to partially condense it; and (a) said partially condensed gas stream is separated thereby to provide a vapor stream and at least one liquid stream;

(b) said vapor stream is thereafter divided into said first and second streams; and (c) at least a portion of said at least one liquid stream is expanded to said lower pressure and is supplied to said distillation column at a lower mid-column feed position below said mid-column feed position.

3. The process according to claim 2 wherein (a) said first stream is combined with said at least one liquid stream to form a combined stream, whereupon said combined stream is cooled to condense substantially all of it; and (b) said substantially condensed combined stream is divided into at least said first condensed portion and said second condensed portion.

4. The process according to claim 2 wherein (a) said first stream is combined with a portion of said at least one, liquid stream to form a combined stream, whereupon said combined stream is cooled to condense substantially all of it;

(b) said substantially condensed combined stream is divided into at least said first condensed portion and said second condensed portion; and (c) a remaining portion of said at least one liquid stream is expanded to said lower pressure and its supplied to said distillation column at said lower mid-column feed position.

* * * * *